United States Patent [19]

Kulla

[11] 4,259,135

[45] Mar. 31, 1981

[54] GLAZING TECHNIQUE

[75] Inventor: Josef Kulla, Witten, Fed. Rep. of Germany

[73] Assignee: BFG Glassgroup, Paris, France

[21] Appl. No.: 971,699

[22] Filed: Dec. 21, 1978

Related U.S. Application Data

[62] Division of Ser. No. 842,607, Oct. 17, 1977, abandoned.

[30] Foreign Application Priority Data

Oct. 26, 1976 [DE] Fed. Rep. of Germany ..... 2648295

[51] Int. Cl.[3] ..... B32B 31/10; B32B 3/06; E04B 2/88

[52] U.S. Cl. ..... 156/293; 52/208; 52/213; 52/397; 52/399; 52/400; 52/403; 52/743; 52/773; 52/774; 52/776; 156/71; 156/145; 156/303.1; 156/305; 156/273; 428/34; 428/83; 428/122; 428/192

[58] Field of Search ..... 52/208, 213, 397, 399, 52/400, 727, 728, 743, 769, 773, 774, 775, 776, 403; 156/107, 145, 293, 303.1, 305; 428/34, 83, 122, 192

[56] References Cited

U.S. PATENT DOCUMENTS

| | | | |
|---|---|---|---|
| 2,356,878 | 8/1944 | Painter | 52/208 |
| 2,620,905 | 12/1952 | Hallauer | 52/769 |
| 3,016,993 | 1/1962 | Owen | 52/773 X |
| 3,037,810 | 6/1962 | Kelley | 52/208 |
| 3,194,364 | 7/1965 | Kolm | 52/397 |
| 3,415,701 | 12/1968 | Haldane et al. | 156/293 X |
| 3,802,143 | 4/1974 | Adler et al. | 52/400 |
| 4,106,969 | 8/1978 | Puyplat | 156/275 |
| 4,163,076 | 7/1979 | Katoh | 428/339 |

FOREIGN PATENT DOCUMENTS

| | | |
|---|---|---|
| 218187 | 11/1961 | Australia . |
| 1969281 | 9/1967 | Fed. Rep. of Germany . |
| 6949025 | 4/1970 | Fed. Rep. of Germany . |
| 1659744 | 4/1970 | Fed. Rep. of Germany . |
| 1683661 | 4/1971 | Fed. Rep. of Germany . |
| 1704450 | 5/1971 | Fed. Rep. of Germany . |
| 1759962 | 7/1971 | Fed. Rep. of Germany . |
| 1683156 | 3/1976 | Fed. Rep. of Germany . |

OTHER PUBLICATIONS

"Glaswelt 1960", pp. 128–130.

*Primary Examiner*—William A. Powell
*Assistant Examiner*—Robert A. Dawson
*Attorney, Agent, or Firm*—Hill, Van Santen, Steadman, Chiara & Simpson

[57] ABSTRACT

A technique for factory glazing of glass panes in window frames is provided. Each frame has a pane receiving groove which corresponds in its depth approximately to the thickness of the glass pane. This groove is filled with a pane edge and a hardenable sealing mass. The invention further relates to a process for factory glazing of glass panes, in particular, glass panes which have been individually inserted into a window frame groove that is open or accessible on one side and that corresponds in its depth approximately to the thickness of the glass pane. When such groove is filled with a hardenable sealing mass, the latter is subsequently hardened.

5 Claims, 3 Drawing Figures

GLAZING TECHNIQUE

This is a division, of application Ser. No. 842,607, filed Oct. 17, 1977, now abandoned.

BACKGROUND OF THE INVENTION

The field of this invention lies in the glazing of a window frame and a glass pane, in particular, a double glass pane, which pane is inserted into a window frame groove.

In the known glazing process which is described in U.S. Pat. No. 3,667,179, double glass panes are glazed by inserting them into the groove of a horizontally arranged frame member and the groove or slot is filled with a heat-hardenable sealing mass of the polysulfide type, after which such mass is hardened. In this process, the double glass pane thus rests directly on the groove bottom, and the sealing mass thus can only fill up the open groove space situated between the adjacent edge portions of the glass pane and the groove wall. After the heat-hardenable sealing mass is hardened, the open side of the groove is then, in this method, covered with a glass retention strip or bar on whose edge facing toward the pane surface but facing away from the groove bottom there is located an elastic sealing layer. This known technique has the disadvantage that the connection between the glass pane and frame is produced exclusively by the adhesive connection effectuated by means of the sealing mass, which connection naturally, after the sealing mass is hardened, can exert no elastic pressure on the groove bottom or on the groove wall. on the one hand, and, on the other hand, on the glass pane. Accordingly, the danger exists that, as a consequence of the forces acting on the pane in the use thereof, such as wind pressures, and the like, such connection between frame and glass pane comes somewhat undone, so that moisture, dirt and biological agents can penetrate into the groove space particularly from the pane surface adjacent to the groove. The result is that the sealing mass is attacked, and such connection is finally completely loosened. On the side facing away from the groove bottom, the sealing profile provided on the glass retention strip is, to be sure, capable of preventing the occurrence of this kind of phenomena, but only when the glass retention strip is successfully attached to the frame with such a lasting pressure that the elastic sealing layer retains a permanent elastic deformation during the duration of use of the pane; that is, such layer rests against the glass retention strip and the pane surface facing away from the groove bottom with considerable contact pressure. Such pressures can be achieved only with difficulty, so that, in the course of time, the same creeping loosening phenomena must be feared on the pane surface portions located adjacent the bottom as occur on the pane surface portions facing toward the groove bottom, which same surface portions are usually always exposed to weather influences.

The above described disadvantage of the glazing according to U.S. Pat. No. 3,667,179 cannot be avoided by a process such as described in German O S No. 1,704,450, in which a glass pane is cast into a frame profile. Here as well, an adhesive connection with the frame is effectuated only by means of the casting mass and no provision is made for a permanent elastic pressing of the sealing mass against the pane, on the one hand, and the frame, on the other hand.

Such disadvantage is also no overcome by the technique disclosed in German O S No. 1,683,661 when the casting of an elastic polyurethane edge jacketing is shown. Such jacketing is pressed after assembly. However, in this case also the permanent pressure exerted on the connection surface between the sealing mass and the glass pane depends decisively on the glass retention strip being connected to the frame in the clamped position reliably and without yielding. Above and beyond that, a problem exists here in that the sealing mass cannot be optimized with respect to its ability to guarantee a dependable adhesive connection between the frame and the pane. Because of considerations of process-technology, a compromise must be sought between the necessary elastic characteristics of the sealing mass and its adhesive characteristics, among other factors.

German O S No. 1,759,962 teaches the use of prefabricated elastic rubber strips fitted onto the pane edges, by means of which, in a per se advantageous manner, an elastically compressable sealing profile thus rests against the pane edges, but this technique provides no adhesive connection whatsoever between the glass pane and the frame, so that, with the characteristic fatigue phenomena associated with elastic rubber strips, creeping phenomena, and the like, can easily ensue.

Similar disadvantages exist for the glazing technique according to German A S No. 1,659,744, in which a plastic or malleable intermediate layer is elastically positioned between the frame profile parts and the adjacent pane, just as, in the case of glazing according to German A S No. 1,683,156, and German Utility Model Nos. 1,969,281 and 6,949,025, only elastic, mechanically pressed on sealing profiles are provided, without adhesive connection.

The use of hardenable sealing masses without permanent contact pressure on the pane surfaces is shown, finally, as well, by Austrian Pat. No. 218,187, U.S. Pat. No. 3,415,701 and by the glazing process for all-glass double panes described in the publication "Glaswelt 1960", pp. 128 to 130.

BRIEF SUMMARY OF THE INVENTION

The present invention is directed to improved glazed windows, doors, and the like, to a process for accomplishing such glazing, and to a device for accomplishing such production. The above indicated disadvantages are avoided and an improved seal between pane and frame is produced by the practice of this invention.

By the present invention, in glazing, there is arranged on each frame groove bottom a first elastically deformable, preferably compressable, sealing profile or layer. This profile contacts the pane outside edge surface portions facing toward the groove wall portions in the frame. This first sealing profile is pressed between the groove and the glass pane and this profile is maintained permanently elastically deformed.

This invention appears to be distinguishable in one aspect from the prior art by the fact that the frame groove bottom is provided with an elastically deformable, preferably compressable, first sealing profile; and the additional fact that, during the hardening of a hardenable sealing mass inserted between pane sides and the groove portions the glass pane is pressed against the groove with this first profile therebetween.

A new device is provided by the present invention for carrying out such above indicated glazing procedure.

Other features, advantages, uses, applications, aims, objects, purposes, features, and the like will be apparent to those skilled in the art from the accompanying description taken with the accompanying drawings.

DETAILED DESCRIPTION

Figure 1:
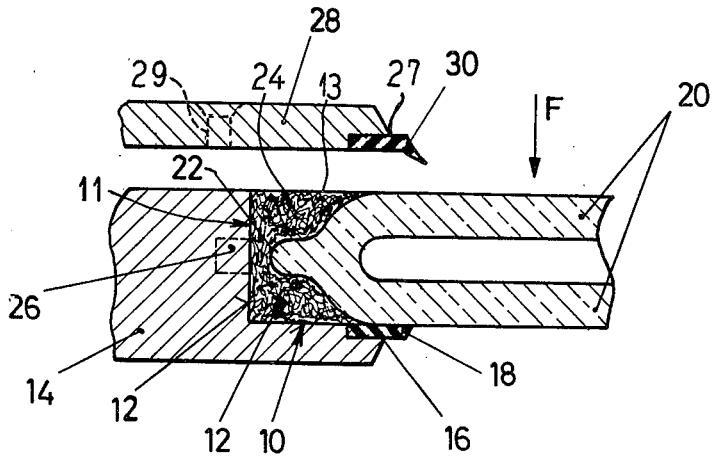
FIG. 1 is a fragmentary, vertical, sectional view through a portion of one embodiment of a frame and double pane assembly of the present invention being sealingly interengaged with one another in accordance with the present invention.

The device provided herein for practicing the present invention utilizes a horizontal conveyor path, such as one define by a conveyor belt, on which window frames each provided with a first sealing profile are sequentially conveyed in a horizontal orientation from a loading station to a pane inserting station, where the individual glass panes are inserted into the respective window frames. Each such assembly of frame and pane is then carried through a clamping station in which the glass panes are weighingly clamped through a casting station in which the frame groove is filled with the hardenable sealing mass, through a hardening station in which the sealing mass is hardened, through an unclamping station in which the clamping of the glass panes is removed, and, finally through an unloading station. An elongated guide path is arranged in spaced relationship above the conveyor path. The spacing of such guide path from the conveyor path in the region of the clamping station, in the region of the insertion station, in the region of the unclamping station, and in the region of the unclamping station is greater than in the region of the respective clamping, casting, and hardening stations. Synchronously along the guide path relative to the conveyor path, in a sequence corresponding to the mutual spacing of the respective window frames sequentially positioned on the conveyor path, movable traveling bodies are provided from each of which a clamping weight is suspended by means of a longitudinally fixed but laterally flexible connecting member, such as a chain, or the like, in such a way that a clamping weight comes to rest on each glass pane only in the regions of the respective weighting, casting and hardening stations, and is lifted up from the panes in the other sections or regions of the conveyor path.

A known heat-hardenable sealing mass which is initially preferably thermoplastic, preferably a sealing mass of the polyurethane type, is used to achieve the desired permanent elastic deformation, and preferably compression, of the sealing profile, or profiles as the case may be, used in mounting panes in frames by exerting during construction a force on each glass pane, or, respectively, on the pane retention strip, before beginning the hardening operation of the sealing mass, so that, at least, the elastically compressible first sealing profile situated between the groove bottom and the adjacent edge portions of the glass pane is kept in its desired deformed, preferably compressed state, by the hardened sealing mass. The rigidity characteristics of the hardened sealing mass are suitably adjusted in a manner readily familiar to those skilled in the art of plastics. As a result, without any clamping elements, or the like, being required, the first sealing profile is maintained under a relatively high contact-pressure during the entire life span of the completed pane and frame assembly in the region thereof between pane edge surface portions and the frame groove portions. In one embodiment form of the invention, a second sealing profile is located between the pane edge surface portions and an adjacent pane retension strip as well. Thus, an additional or second elastic seal of high contact pressure is provided while retaining the desired, favorable characteristics of a connection between frame and glass pane by means of a hardenable sealing mass.

It is to be appreciated as an especially important feature that the material parameters of the sealing mass, on the one hand, and of the first sealing profile, or, respectively, profiles, as the case may be, on the other hand, can be adjusted completely independently of one another. The sealing mass can, for example, be selected in such a way that optimum features result not only in a process-technology sense, but also in respect to the strength or rigidity of the connection, while, the sealing profile can, for example, be selected merely by selecting a material which is deformable, and preferably compressible, and preferably having a high permanent restoring force. In this regard, a profile incorporating a hollow chamber can provide preferred advantages. Such profiles are of particular advantage when an adhesive sealing mass is used, since, in this case, the first sealing profile, or, respectively, profiles, as the case may be, are themselves bonded on the one side, zone-wise, by means of the sealing mass, as a result of which the sealing effect is still further improved. When anchoring devices or arrangements are employed which project into the hollow groove space, or, alternatively, are connected thereto as anchoring means, then the sealing mass does not, however, need to be adhesive for achieving the desired purpose of producing a permanent elastic compression of the sealing profile, since, in that case, a form-locking connection of the hardened sealing mass with the frame comes about which prevents a yielding or expanding of the first sealing profile after the removal of the force comprising the first sealing profile during the sealing mass hardening.

By means of the glazing technique of the invention, the window frame itself is thus used in connection with the glass pane as a casting form of the hardenable sealing mass. Thus, ready-to-install glazings, and preassembled all-glass double panes, can be employed without the previously necessary, considerable expense for sealing, blocking, etc., of the glass panes. As a consequence of its compact construction, the thus-produced glazing is suitable in particular for use with swinging windows of all types, where, in applications, such as for skylights, dormer windows, and the like, the high degree of glazing tightness that is achieved by this invention is of particular advantage.

It is preferred that, when the sealing mass is introduced into the hollow groove space in the casting process, the mass is initially so fluid that it can completely fill up the hollow groove space and entirely penetrate into the fine branchings, around the small projections, recesses, etc., in order in this way to guarantee an intimate connection of the glass pane, the window frame and the first sealing profile, or profiles, as the case may be, by means of the hardened sealing mass. When, however, one of the prior art common injection methods used in the production of insulating glass panes is employed for introducing the sealing mass into the frame groove, then the injection pressure is selected preferably to be correspondingly high, in order to completely fill out the hollow groove space in the described manner, in accordance with the viscosity of the unhardened sealing mass.

In the embodiment shown in FIG. 1, a conventional all-glass double pane assembly 20 is inserted into a groove 11 of a window frame 14, which can consist of wood, metal, or synthetic material. Groove 11 has a side wall 10 and a bottom wall 12. A first sealing profile 18 has a base portion inset into sidewall 10 and projects outwardly from edge 16 of groove 11 in such a way that the rounded edge portion 22 of double pane assembly 20 is spaced but adjacent to bottom wall 12. The space in groove 11 about portion 22 is filled, as shown in FIG. 1, with an adhesive sealing mass 24 which is initially thermoplastic, but is heat setting, such as a polyurethane based material or the like. If desirable, an anchoring notch or channel 26, illustrated with a broken line in FIG. 1, can also be provided in the bottom wall 12. The sealing mass 24 then naturally also fills notch 26. The opposed side wall 13 has fitted thereagainst as by screws 29 or the like a pane retention strip 28 comprised of metal or plastic. A second sealing profile 30 has a base portion inset into strip 28 and projects outwardly from edge 27 of strip 28. Profiles 18 and 30 are paired and are formed of elastic, flexible plastic or rubber, or the like so shaped as to be yieldingly biased against portion 22 therebetween in a completed assembly. The profiles 18 and 30 are preferably also compressable. Profiles 18 and 30 can be fastened to their adjoining strip 28 or frame 14 by an adhesive or the like (not shown) as desired.

The production of the glazing described in FIG. 1 is producible in the following manner: Double pane 20 is laid into the groove 11 of the horizontally oriented frame 14 in the manner FIG. 1 with the profile 18 already in place so that pane 20 rests initially on the first sealing profile 18. Thereupon, in the direction of the arrow F, there occurs a weighting of the pane 20 is provided with a clamping weight means sufficient to apply a force against pane 20 and profile 18 of, for example, at least about 100 kp/m$^2$. As a result, the elastic, flexible compressible first sealing profile 18 is pressed against pane 20. Thus pane 20 rests not only against the recessed surface of the side wall 10, but also against the inner surface of the profile 18.

Then the space remaining in groove 11 is filled with the castable, heat-hardenable sealing mass 24, after which the sealing mass 24 is hardened. In accord with the invention, during the entire hardening operation, the force acting in the direction of the arrow F is continuously exerted on the all-glass double pane 20. After the sealing mass 24 has been hardened, the force F is removed from the all-glass double pane 20. However, after force F is removed, the elastic deformation of the first sealing profile 18 is still maintained. Profile 18 remains in tight contact with pane 20 and so does side wall 10. The elastic deformation of the sealing profile 18 is, as it were, "frozen-in" by the hardened sealing mass 24 which firmly adheres not only to the pane 20, but also to the side wall 10 and the bottom wall 12, as well as preferably to the sealing profile 18 itself. Subsequently, the pane retention strip 28 is then brought from a position such as shown in FIG. 1 downwardly into contact with the frame 14. The second sealing profile 30 is placed against the pane 20 opposite profile 18. The pane retention strip 28 is then attached to the frame 14 in a known manner, such as by pane screws 29. In this fashion, a glazing of pane 20 relative to frame 14 results, in which, in addition to the already known adhesive bond between the pane 20 and the frame 14, a permanent elastic seal between the frame 14 and the pane 20 is provided as a consequence of the "frozen-in" elastic deformation or compression of the first sealing profile 18.

It is also possible, if desired, to proceed in such a way, in making a sample embodiment such as shown in FIG. 1, that, after the filling of the hollow space in groove 11 by means of a still-liquid sealing mass 24, for the pane retention strip 28 to be pressed against the frame 14. As a result, the second sealing profile 30 is also flexed and compressed, whereupon the sealing mass then "freezes in" the elastic deformation not only of the first sealing profile 18, but also of the second sealing profile 30, this creating a solid, unyielding adhesive connection. Of course, the hardness of the sealing mass 24 is chosen in a manner known to a person skilled with synthetic plastic materials to form a good bond between the frame 14, the pane 20, the pane retention strip 28, and the profiles 18 and 30. In this embodiment, it is preferred to arrange the pane vertically and to apply the necessary contact pressure force onto the pane retention strip 28 in a different manner than by gravity weighting, in order in that way to guarantee an easier, complete filling of the hollow groove 11 with the sealing mass 24.

Figure 2:
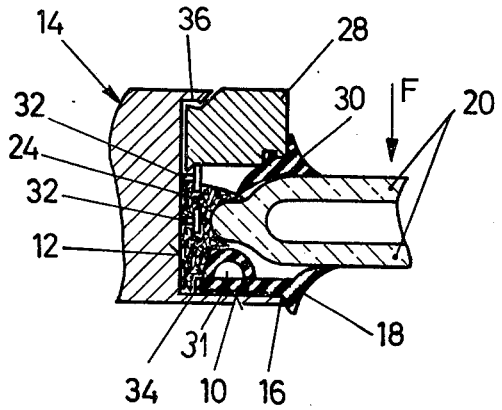
FIG. 2 is a view similar to FIG. 1, but showing another such embodiment.

In the sample embodiment shown in FIG. 2, the first sealing profile 18 incorporates a hollow chamber 31 which produces an especially extensive elastic compression in profile 18 as a consequence of the force continuously exerted on the all-glass double pane 20 in the direction of the arrow F during the hardening of the sealing mass 24. Instead of the optionally provided anchoring notch 26 in FIG. 1, projections 32 are arranged on the bottom wall 12, while the side wall 10 is provided with a continuously extending projection 34. As a consequence of their greater diameters at their respective ends facing away from the bottom wall 12, the projections 32 have the effect of producing a good anchoring of the sealing mass 24 to the frame 14. The glazing in the embodiment shown in FIG. 2 is initially produced in the same manner as that employed in the embodiment of FIG. 1 leaving out the pane retention strip 28 and the second sealing profile 30 attached thereto. Subsequently, the pane retention strip 28 is then pushed into place under a flexible shoulder 36 integrally formed with the frame 14 which longitudinally extends along one side of frame 14. Here, frame 14 is comprised of an extruded of plastic or the like, and the pane retention strip 28 is clamped tightly between pane 20 and shoulder 36. Simultaneously, the second profile seal 30 which is adapted to engage a corner portion of strip 28, as shown, at a region generally opposed to profile 18 presses against the adjacent surface of the pane 20 without further fastening means being necessary between strip 28 and frame 14.

Figure 3:
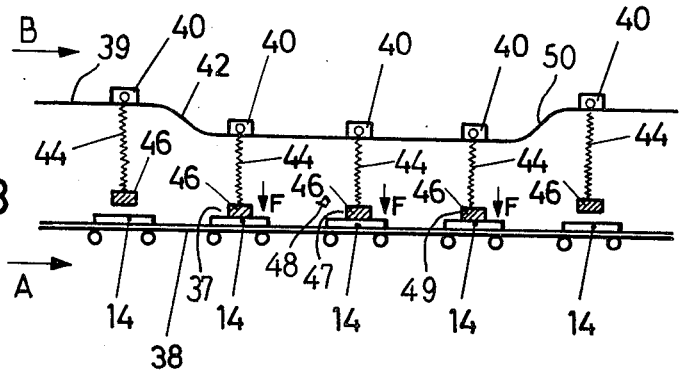
FIG. 3 is a diagrammatic illustration in said elevation of one embodiment of novel glazing apparatus adapted for the practice of the present invention.

In FIG. 3, an apparatus suitable for a preferred practice of the present invention is shown. This apparatus employs a plurality of frames 14 is arranged in longitudinally equally spaced relationship to one another on a conveyor belt 38 which moves from left to right in the direction shown by arrow A. Before the frames 14 come into the region of the inventive apparatus shown in FIG. 3, they are each provided with a first sealing profile 18, and each is fitted with a pane 20 duly positioned into groove 11 of each frame 14. Also, the sealing mass 24 has already been applied to fill in voids remaining in groove 11. Each thus partially constructed pane frame arrangement sequentially enters, as shown in FIG. 3, from the left under a traveling line of roller trucks 40 which translate along a track 39. Alternatively, an endless conveyor chain, or the like moving along an upper guide path in the direction shown by the arrow B can be employed. The spacing and orientation of each roller truck 40, is controlled and generally synchronized with movements of conveyor belt 38 so that one rollertruck 40 is situated above each frame 14 during apparatus operation and fabrication according to this invention. A weight 46 is suspended by means of a chain 44 from each roller truck 40. Thus, when each frame 14, pane 20 glazing arrangement prepared as above indicated moves sequentially into a clamping station region 37. Concurrently, a roller truck 40 with chain 44 and weight 46 is located thereover. Owing to a downward curvature 42 in the path of movement of chain 39, a roller truck 40 moves downwardly relative to conveyor belt 38 in the region preceding station 37. As a result, and as shown in the drawing, a weight 46 is placed onto the glass pane 20 situated in the glass frame 14, producing a clamping force F which effectuates the desired pressing together of the first sealing profile 18 and the pane 20. Each weight 46 remains on an associated pane 20 during the continuing transport of each glazing arrangement through the hardening station region 47 in about in the mid region of FIG. 3. In hardening station region 47, heat is applied to the sealing mass 24 sufficient for a rapid hardening thereof. For this purpose, high frequency, infrared radiation, or the like, can be employed, as from a source 48. After passing the hardening station region 47, each glazing arrangement passes into an unclamping station region 49 shown at the right of station region 47 in FIG. 3. Here, an upward curvature 50 in the guide path of conveyor chain 39 is provided so that each roller truck 40 moves upward relative to conveyor belt 38. As a result, each weight 46 is lifted away from its previously associated pane 20. Each glazing arrangement is then ready for further processing, such as, for example, for the mounting of pane retention strip 28, or against frame 14 (not detailed in FIG. 3).

The preceding description demonstrates that the present invention provides the capability for glazing to a frame panes, especially all-glass double panes, in a production line and still achieve improved sealing while avoiding the previously necessary blocking.

It is much preferred, in carrying out the invention to employ a sealing mass which is a low viscosity state during the filling into the hollow groove space. Thus, a sealing mass can penetrate into the smallest regions present in this space, such as can be caused, for example, by projections, anchoring notches, etc. The fluidity or viscosity of a sealing mass in its non-hardened state is also desirable for achieving an intimate connection between glass pane, frame, sealing profile (or, profiles) and the sealing mass, and optionally even also the pane retention strips, which is of decisive importance for achieving the desired permanent elastic compression of at least profile 18 and preferably also profile 30. In a preferred embodiment form of the invention, a device such as illustrated in FIG. 3 has each frame 14 comprised of metal, and each frame 14 is connected as an electrode to an electrical high-frequency energy source, most preferably as a ground electrode, whereupon, with the addition of an appropriately arranged counter-electrode, a capacitive high-frequency heating-up of the sealing mass, which is thermosetting in this case, can then easily be carried out. When the frame 14 is metallic not only, as in the other sample embodiments, is the frame **14*a* casting form for the sealing mass 24**, but also it serves one of the electrodes for capacitive high-frequency heating.

Preferably a frame and pane construction of this invention employs a pane retension means which includes anchoring means adapted for interlocking with the sealing mass, such as molded extensions or the like similar to those employed in the frame groove. Preferably anchoring extensions on the frame groove or the pane retension means have a greater volume at their respective end portions than they do at their respective base portions adjacent to the adjoining said frame means.

Preferably, the sealing mass used is initially thermoplastic, and preferably the sealing mass in a product construction employs sealing mass which is thermoset. Preferably in a product construction, the sealing mass is so compounded as to be adherent to all surfaces contacted therewith. Preferably, the sealing mass is initially in a fluid state as applied before being thermally hardened. After being hardened, the sealing mass is preferably coated with a layer of ultraviolet light screening material. A preferred first sealing strip means incorporates a hollow cavity which extends therein longitudinally. Preferably the second sealing strip is also compressable.

Preferably, in a construction of this invention, the first sealing strip is compressible.

In a construction of this invention, a frame groove has a size such that its depth approximately corresponds to the thickness of the pane means associated therewith.

Preferably, the second elastically deformable sealing strip means is compressed against the pane means in opposed relationship to the first sealing strip means. The second strip means can be so compressed after the hardening of the sealing mass or before such hardening, though in the latter case, the clamping pressure on the pane is also used to provide such compression force conveniently.

Preferably the space in the frame groove is substantially completely filled with the sealing mass. During manufacture, the assembly of the frame means and the pane means is preferably horizontally oriented, and the said clamping pressure is applied by gravitationally acting weight means. A preferred weight means is about 100 $kp/m^2$.

Alternatively, the clamping pressure is provided by suction loading (reduced air pressures) applied to the pane means. The heat used for sealing mass hardening can be produced by capacitative high frequency heating of said sealing means.

In the apparatus for carrying out the glazing according to this invention, a plurality of flexible, fixed length chain-like suspending members extending downwardly from each one of the roller trucks, all suspending members having about the same length, weight means supported from an end region of each suspending member, a plurality of work stations are located along mid portions of the horizontal path of conveyor belt travel. A first such work station comprises a clamping station, wherein said weight means are restable upon individual ones of said pane surfaces. A second such work station comprises a casting station where each frame groove is filled with hardenable sealing mass. A third such work station comprises a hardening station where sealing mass in frame grooves is hardened. A fourth such work station comprises an unclamping station wherein the weight means is removed from the individual pane surfaces.

In an alternative such apparatus, the track means, the roller trucks, the suspending members, and the weight means are replaced by vacuum suction devices which are brought to rest functionally against the glass panes individual frames in the clamping station. These suction devices are released from the glass panes in the unclamping station. Thus, there is applied to each glass pane a predetermined force sufficient to compress each said pane against said first sealing means before hardening of the sealing mass. Preferred such apparatus has a hardening station incorporating a subassembly for producing a high frequency heating up of the sealing mass.

Although the teachings of my invention have herein been discussed with reference to specific theories and embodiments, it is to be understood that these are by way of illustration only and that others may wish to utilize my invention in different designs or applications.

I claim:

1. A method for glazing a window frame with a glass pane, said window frame having a groove of a depth substantially equal to the thickness of the window pane, comprising the steps of:

providing the pane-parallel wall of said groove with an elastically deformable, compressible, first sealing profile which projects from the groove, in a direction parallel to the pane;

inserting said glass pane into the window frame with said first sealing profile abutting said glass pane in the installation area of the pane;

filling the space remaining in said groove with a hardenable sealing mass;

covering said groove filled with said hardenable sealing mass with a glass pane retention strip which manifests a second elastically deformable, compressible sealing profile resting against the glass surface opposite the surface facing the groove wall, in the marginal region of the glass pane;

pressing said glass pane in a direction towards said pane-parallel wall, to bias and deform said first and second sealing profiles against said glass pane, providing a continuous seal;

subsequently hardening said sealing mass to maintain the sealing profile in a biased and deformed condition; and removing the pressure from against said glass pane, whereby the glass pane and first sealing means remain in a biased relationship as the glass pane is retained in the pressed position by the hardened sealing mass and the glass retaining strip is applied prior to said hardening of the sealing mass, the force pressing said glass pane against said groove wall provided with said first sealing profile is exerted on said glass pane retention strip, and the glass retention strip is cemented by said sealing mass subsequent to its hardening and is fixed with regard to its position.

2. The method of claim 1 wherein said first sealing profile on the groove wall is arranged in proximity of the groove edge.

3. The method of claim 1 wherein said pressing of said glass pane against said groove wall provided with said first sealing profile takes place directly on the glass pane.

4. The method of claim 1 wherein said window frame is horizontally arranged, and that the pressure is applied by a dead weight.

5. The method of claim 1 wherein the pressure of said glass pane against said groove wall is applied by suction stress exerted upon said glass pane.

* * * * *